US005169059A

United States Patent [19]

Desmond et al.

[11] Patent Number: 5,169,059

[45] Date of Patent: Dec. 8, 1992

[54] DISPENSING CARTON WITH INTEGRAL SIDE WALL POUR SPOUT

[75] Inventors: John D. Desmond, Philadelphia; Frederick M. Allsop, Lansdale, both of Pa.

[73] Assignee: Container Corporation of America, Clayton, Mo.

[21] Appl. No.: 865,834

[22] Filed: Apr. 9, 1992

[51] Int. Cl.[5] ..... B65D 5/70; B65D 5/74

[52] U.S. Cl. ..... 229/215; 229/125.04; 229/125.09; 229/125.42

[58] Field of Search ..... 229/214, 215, 217, 218, 229/219, 125.04, 125.09, 125.42; 222/528

[56] References Cited

U.S. PATENT DOCUMENTS

| | | | |
|---|---|---|---|
| 1,539,985 | 6/1925 | Allen | 229/215 |
| 1,907,939 | 5/1933 | Venning et al. | 229/215 |
| 2,330,464 | 9/1943 | Atterbury | 229/125.42 |
| 2,358,659 | 9/1944 | Ringler | 229/215 |
| 2,601,399 | 6/1952 | Jones | 229/214 |
| 3,055,571 | 9/1962 | Hassler | 229/125.42 |
| 3,085,733 | 4/1963 | Umanoff | 229/219 |
| 3,438,555 | 4/1969 | LaPierre | 222/528 |
| 4,054,240 | 10/1977 | LaPierre | 229/215 |
| 4,569,443 | 2/1986 | Roccaforte | 229/215 |

FOREIGN PATENT DOCUMENTS

| | | | |
|---|---|---|---|
| 233475 | 3/1960 | Australia | 229/215 |
| 713717 | 8/1954 | United Kingdom | 229/215 |

*Primary Examiner*—Gary E. Elkins
*Attorney, Agent, or Firm*—Richard W. Carpenter

[57] ABSTRACT

A one-piece, collapsible, paperboard, dispensing carton having in one side wall adjacent an upper end of the carton an integral pour spout that can be pulled part way out of the carton for dispensing. The pour spout is formed from material of one of the carton side wall panels and has a slit and a projecting tab that are engageable with another carton panel to hold the pour spout in proper open position for dispensing and to prevent the pour spout from being accidentally pulled completely out of the carton.

5 Claims, 2 Drawing Sheets

DISPENSING CARTON WITH INTEGRAL SIDE WALL POUR SPOUT

BACKGROUND OF THE INVENTION

1. Field of the Invention

This invention relates to paperboard dispensing cartons of the type used in the packaging of dry granular products, such as sugar, salt, powder detergents and the like, and more particularly to a collapsible dispensing carton having an integral pout spout in a side wall thereof.

2. Description of Background Art

A background art search directed to the subject matter of this invention conducted in the United States Patent and Trademark Office disclosed the following U.S. Pat. Nos.: 2,007,553, 2,029,747, 2,348,310, 2,358,659, 2,760,708, 3,178,090, 3,438,555, 3,549,079, 3,565,300, 3,989,171, 4,054,240, 4,150,778.

None of the patents found in the search discloses a collapsible, paperboard, dispensing carton with an integral side wall pour spout adapted to be pulled out of the carton for dispensing and which includes integral means for maintaining the pour spout in a predetermined position for dispensing and also means for preventing the pour spout from being accidentally pulled completely out of the carton.

SUMMARY OF THE INVENTION

It is a primary object of the present invention is the provision of an improved, collapsible, paperboard, dispensing carton with an integral side wall pour spout.

A more specific object of the invention is to provide a carton of the type described which includes integral means to maintain the pour spout in a predetermined position for dispensing and other integral means to prevent the pour spout from being accidentally pulled completely out of the carton.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
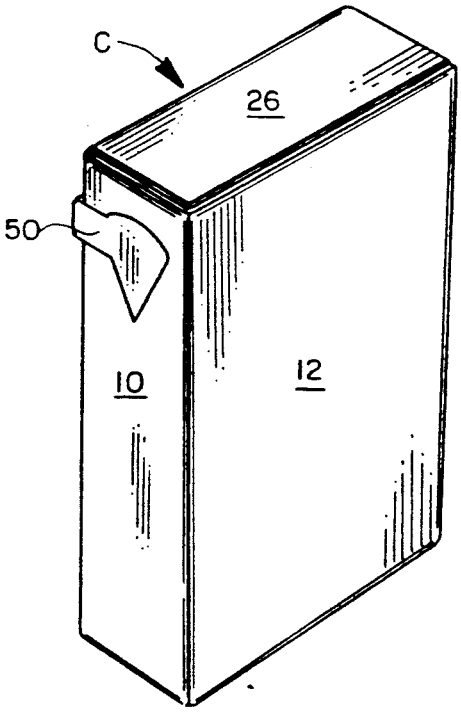
FIG. 1 is an isometric view of a carton embodying features of the present invention, shown erected and unopened.
Figure 2:
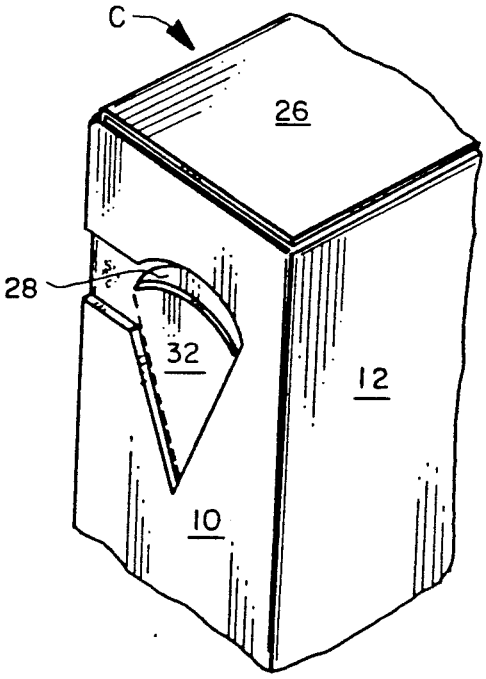
FIG. 2 is a view similar to that of FIG. 1, but showing only an upper portion of the carton after the pour spout cover has been detached and removed from the carton.
Figure 3:
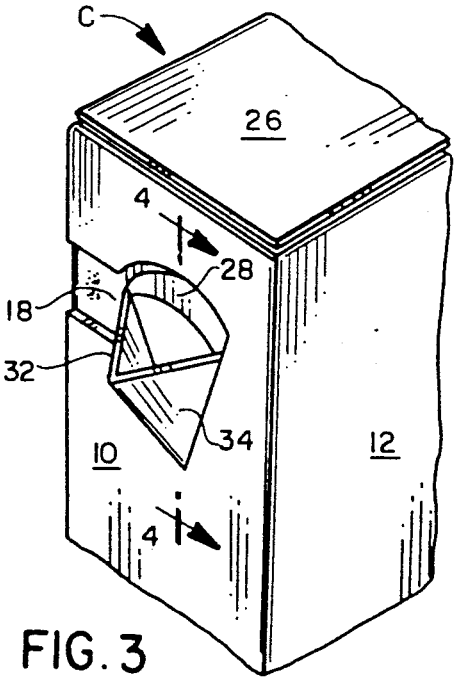
FIG. 3 is a view similar to that of FIG. 2, but shown with the pour spout pulled out to a dispensing position.
Figure 4:
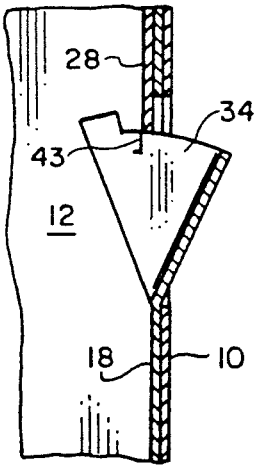
FIG. 4 is a fragmentary, vertical, sectional view taken on line 4—4 of FIG. 3, showing the pour spout slit engaging the retaining panel lower edge.
Figure 5:
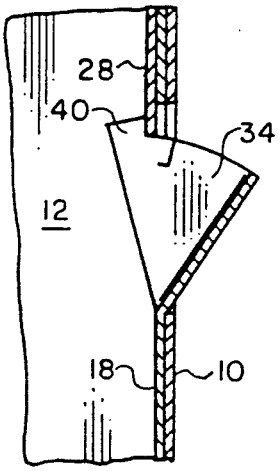
FIG. 5 is a view similar to that of FIG. 4, but showing the pour spout lock tab engaging the retaining panel.
Figure 6:
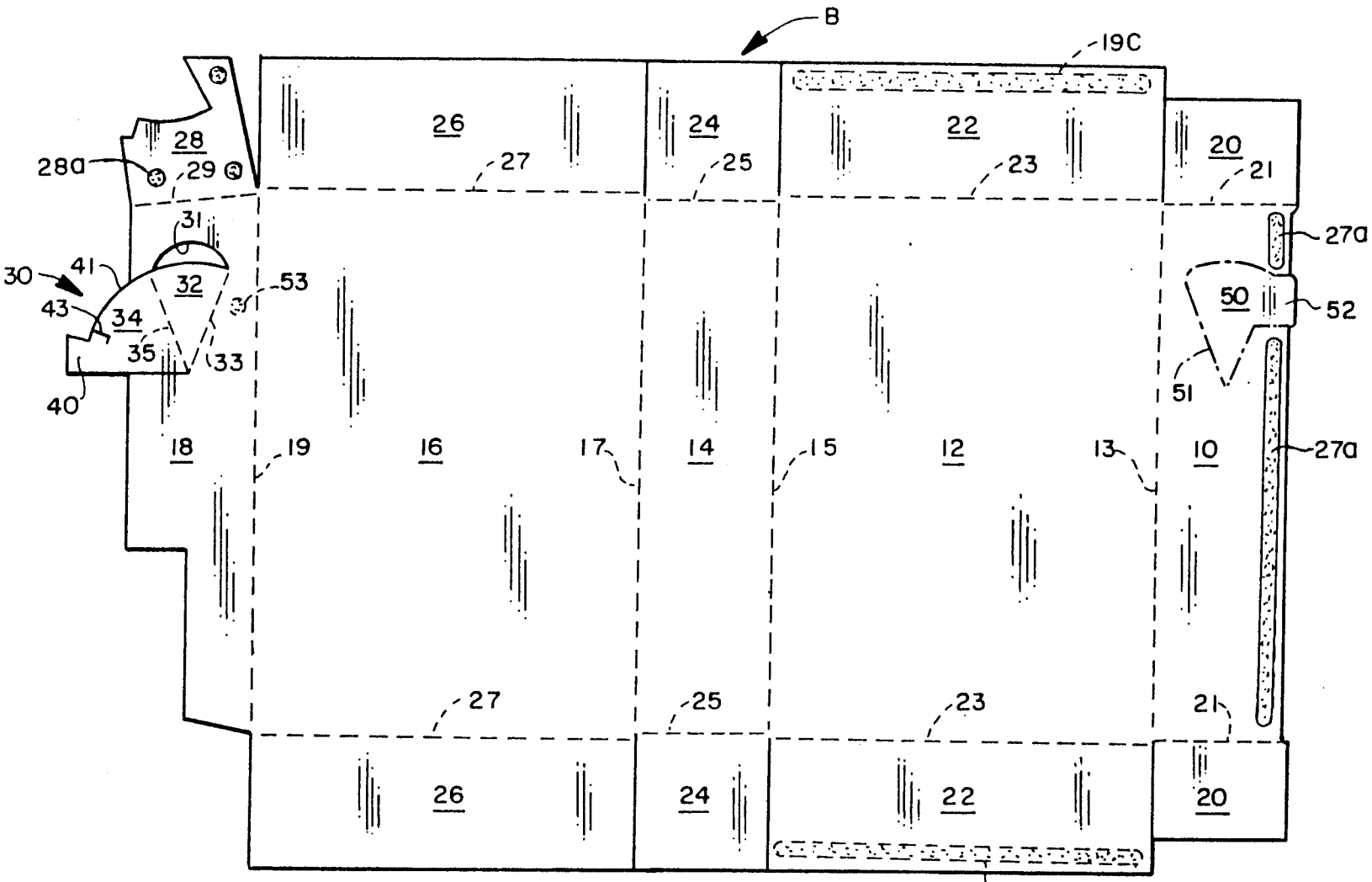
FIG. 6 is a plan view of a blank of sheet material from which the carton illustrated in the other views may be formed.

Referring now to the drawings for a better understanding of the invention, it will be seen that the novel dispensing carton embodying features of the present invention, and indicated generally at C in FIGS. 1-5, may be formed from the unitary blank B of foldable paperboard illustrated in FIG. 6.

Carton C includes a central body portion 8 with an integral pour spout 30 in one wall thereof, as hereinafter described. As best seen in FIG. 6, body portion 8 includes a first minor side wall outer panel 10, a first major side wall panel 12, a second minor side wall panel 14, a second major side wall panel 16, and a first minor side wall inner panel 18, which are serially arranged and foldably joined to each other along parallel fold lines 13, 15, 17, and 19, respectively.

The inner surface of first minor side wall outer panel is adhesively secured, as indicated at 19*c*, to the outer surface of first minor side wall inner panel to form a tubular structure open at its opposite ends.

The upper and lower ends of the tubular carton structure may be closed by opposed pairs of upper and lower closure flaps adhesively secured to each other in overlapped relation.

These flaps include: first minor side wall flaps 20, first major side wall flaps 22, second minor side wall flaps 24, and second minor side wall flaps 26, which are foldably joined to opposite ends of first minor side wall panel 10, first major side wall panel 12, second minor side wall panel 14, and second major side wall panel 16 along fold lines 21, 23, 25, and 27, respectively. The flaps are folded over in overlapped relation and secured by adhesive indicated at 27*a* in FIG. 6.

A retaining panel 28, described later herein, is foldably joined along fold line 29 to the upper edge of first minor side wall inner panel 18 and is folded inwardly 180 degrees and secured by adhesive indicated at 28*a* to the inner surface of an upper portion of the first minor side wall inner panel 18.

First minor side wall inner panel 18 includes an integral pour spout 30 and also has, extending therethrough and located immediately above spout 30, a finger opening 31 which is adapted to facilitate grasping the pour spout as hereinafter described.

As best seen in FIG. 6, the major portion of pour spout 30 is formed from material cut from first minor side wall inner panel 18. Pour spout 30 includes a pair of generall V-shaped first and second sections 32 and 34, respectively.

First section 32 is foldably joined at one side edge, along fold line 33, to an edge of first minor side wall inner panel and is foldably joined at another side edge, along fold line 35, to one side edge of second section 34.

As best seen in FIG. 6, pour spout second section 34 is wider than first section 32 and extends laterally beyond the outer side edge of first minor side wall inner panel 18. It includes a lock tab 40, that projects outwardly or upwardly from an upper edge 41 thereof, and also has, extending inwardly or downwardly from its upper edge 41, a slit 43.

Retaining panel 28 serves more than one purpose. First, when it is folded over and secured to the inner surface of first minor side wall inner panel 18, it covers the finger opening 31 to prevent material from sifting out of the carton, although the opening still affords access to the pour spout from the outside of the carton.

Second, as best seen in FIG. 4, when the pour spout is pulled out from the carton side wall for dispensing, slit 43 in the pour spout second section is engageable with the retaining panel edge 45 to temporarily retain the pour spout in proper position for dispensing.

Third, as best seen in FIG. 5, when the pour spout is pulled out for dispensing, the lock tab 40 of the pour spout second section 34 is engageable with a shoulder 46 of the retaining panel 28 to prevent the pour spout from being pulled completely out of the carton.

Again referring to FIG. 6 of the drawings, it will be seen that there is formed in first minor side wall outer panel 10 a detachable pour spout cover 50 that is defined by a peripheral line of weakness 51. Although line of weakness 51 is shown in the drawings as a single perforated line, in order to minimize leakage or sifting, the line of weakness may be a double cut score, with portions of the cut on both inner and outer sides.

Cover 50 includes a tab portion 52 that extends a slight distance beyond the edge of the carton side wall to make it easier to grasp the pour spout cover.

After the carton has been formed, filled, and closed. It is thereafter opened by grasping the spout cover, which initially may be temporarily secured in place by a spot of adhesive 53, and detaching it from the carton to expose the pour spout.

The pour spout is then grasped by inserting a finger in the finger opening 31 in front of retaining panel 28 and pulling the spout out from the carton until spout slit 43 engages retaining panel edge 45. As previously mentioned, engagement between spout lock tab 40 and retaining panel shoulder 46 serves to prevent the spout from being accidentally pulled completely out of the carton.

Thus, it will be appreciated that the invention provides a one-piece paperboard carton with a unique and improved carton side wall pour spout arrangement that is generally sift-proof and that includes means for retaining the pour spout in a dispensing position and also includes means for preventing the spout from being accidentally pulled completely out of the carton.

What is claimed is:

1. A collapsible dispensing carton having an integral side pour spout, said carton being formed from a unitary blank of foldable sheet material, and comprising:

(a) opposed pairs of major and minor side walls foldably joined to each other to form an open-ended tubular structure;

(b) opposed pairs of major and minor top and bottom closure flaps foldably joined to upper and lower ends of related of said major and minor side walls, respectively, and secured to each other in overlapped relation to close upper and lower ends of said tubular structure;

(c) one of said minor side walls comprising inner and outer panels secured to each other in overlapped relation, and wherein said inner panel includes an integral, movable pour spout adapted to be pulled outwardly for dispensing, and also has, immediately above said pour spout, a finger opening adapted to facilitate the grasping of a portion of said spout;

(d) a retaining panel foldably joined to an upper edge of said inner panel and folded downwardly therefrom and secured to an inner surface of said inner panel over said opening;

(e) said pour spout being formed at least partly from material cut from said inner panel and comprising:

(i) a pair of generally V-shaped first and second sections, said first section being foldably joined, at one side thereof, to said inner panel and foldably joined, at an opposite side thereof, to one side of said second section;

(ii) said second section being wider than said first section and having, adjacent another side thereof, a positioning slit and a retaining tab arranged and disposed for engagement with said retaining panel to temporarily retain said pour spout in an open position for dispensing and to prevent said pour spout from being accidently pulled completely out of said carton;

(g) said one side wall also including a removable pour spour cover member formed from material of said outer panel and detachably secured thereto for the purpose of covering said pour spout and finger opening until said carton is initially opened for dispensing.

2. A collapsible dispensing carbon having an integral side pour spout, said carton being formed from a unitary blank of foldable sheet matrial, and comprising:

(a) opposed pairs of major and minor side walls foldably joined to each other to form an open-ended tubular structure;

(b) opposed pairs of major and minor top and bottom closure flaps foldably joined of upper and lower ends of related of said major and minor side walls, respectively, and secured to each other in overlapped relation to close upper and lower ends of said tubular structure;

(c) one of said minor side walls comprising inner and outer panels secured to each other in overlapped relation and wherein said inner panel includes an integral, movable pour spout adapted to be pulled outwardly for dispensing, and also has, immediately above said pour spout, a finger opening adapted to facilitate the grasping of a portion of said spout;

(d) a retaining panel foldably joined to an upper edge of said inner panel and folded downwardly therefrom and secured to an inner surface of said inner panel over said opening;

(e) said pour spout being formed at least partly from material cut from said inner panel, and comprising a pair of generally V-shaped first and second sections, said first section being foldably joined, at one side thereof, to said inner panel and foldably joined, at an opposite side thereof, to one side of said second section;

(f) said pour spout including means to temporarily retain said pour spout in an open position for dispensing and to prevent said pour spout from being accidently pulled completely out of said carton.

3. A carton according to claim 2, wherein said one side wall also includes a removable pour spout cover member formed from material of said outer panel and detachably secured thereto for the purpose of covering said pour spout and finger opening until said carton is initially opened for dispensing.

4. A carton according to claim 2, wherein said one side wall second section is wider than said first section and wherein said means to temporarily retain said pour spout in an open position for dispensing and to prevent said pour spout from being accidentally pulled completely out of said carton includes a positioning slit and a retaining tab projecting from said second section, respectively, that are each arranged and disposed for engagement with said retaining panel.

5. A blank of foldable sheet material for use in forming a one-piece, collapsible, dispensing carton having an integral side pour spout, said blank being cut and scored to provide:

(a) a first minor side wall outer panel, a first major side wall panel, a second minor side wall panel, a second major side wall panel, and a first minor side wall inner panel foldably joined to each other along parallel fold lines;

(b) opposed pairs of major and minor top and bottom closure flaps foldably joined to opposite ends of certain related of said major and minor side wall panels, respectively;

(c) said first minor side wall inner panel including an integral, movable pour spout adapted, when said carton is erected, to be pulled outwardly for dispensing, and presenting immediately adjacent said pour spout a finger opening adapted to facilitate the grasping of a portion of said spout;

(d) a retaining panel foldably joined to an upper edge of said first minor side wall inner panel;

(e) said pour spout being formed at least partly from material cut from said inner panel and comprising:

(i) a pair of generally V-shaped first and second sections, said first section being foldably joined, at one side thereof, to said inner panel and foldably joined, at an opposite side thereof, to one side of said second section;

(ii) said second section being wider than said first section and having, adjacent another side thereof, a positioning slit and a retaining tab arranged and disposed for engagement with said retaining panel, when said carton is erected, to temporarily retain said pour spout in an open position for dispensing and to prevent said pour spout from being accidently pulled completely out of said carton;

(f) said one side wall also including a removable pour spout cover member formed from material of said outer panel and detachably secured thereto for the purpose of covering said pour spout and finger opening after said carton has been erected and until said carton is initially opened for dispensing.

* * * * *